US009359716B2

(12) United States Patent
Bringewatt et al.

(10) Patent No.: US 9,359,716 B2
(45) Date of Patent: Jun. 7, 2016

(54) DEVICE FOR MANGLING LAUNDRY ITEMS

(71) Applicant: Herbert Kannegiesser GmbH, Vlotho (DE)

(72) Inventors: Wilhelm Bringewatt, Porta Westfalica (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 0 days.

(21) Appl. No.: 14/506,735

(22) Filed: Oct. 6, 2014

(65) Prior Publication Data

US 2015/0096208 A1 Apr. 9, 2015

(30) Foreign Application Priority Data

Oct. 7, 2013 (DE) ..... 10 2013 016 524

(51) Int. Cl.
*D06F 69/02* (2006.01)
*D06F 63/00* (2006.01)

(52) U.S. Cl.
CPC ..... *D06F 69/02* (2013.01); *D06F 63/00* (2013.01)

(58) Field of Classification Search
CPC ..... D06F 67/02; D06F 67/08; D06F 63/00; D06F 63/02; D06F 71/36; D06F 71/38; D06F 65/00; D06F 69/02; D06F 83/00
See application file for complete search history.

(56) References Cited

U.S. PATENT DOCUMENTS

| | | | | |
|---|---|---|---|---|
| 2,686,377 | A * | 8/1954 | Case | D06F 69/02 37/11 |
| 3,788,106 | A * | 1/1974 | True | D06B 11/0076 101/470 |
| 3,797,141 | A * | 3/1974 | Parera | D06F 61/08 38/11 |
| 4,197,663 | A * | 4/1980 | Riedel | D06B 23/04 38/11 |
| 4,377,045 | A * | 3/1983 | Aurensan | D06F 83/00 38/11 |
| 2002/0065008 | A1* | 5/2002 | Stanhope | D03D 15/12 442/181 |
| 2012/0198736 | A1* | 8/2012 | Heinz | D06F 83/00 38/100 |

FOREIGN PATENT DOCUMENTS

| | | |
|---|---|---|
| DE | 8716751 U1 | 2/1988 |
| DE | 3905544 A1 | 8/1990 |

(Continued)

OTHER PUBLICATIONS

European Patent Office, Europaischer Recherchenbericht (European patent search on related European Patent Application No. 14003423) (Nov. 11, 2014).

*Primary Examiner* — Ismael Izaguirre
(74) *Attorney, Agent, or Firm* — Laurence P. Colton; Smith Tempel Blaha LLC

(57) ABSTRACT

Belt mangles, in which a revolvingly driven mangle belt runs along on the outside of the mangle body which is curved in a trough-like manner, convey in an entrained manner laundry items to be mangled along a smooth flattening face of the mangle body. Slippage between the mangle belt and the laundry items, which causes the quality of mangling to suffer, can occur. A mangle belt is provided with a structured outer face to bear on the laundry items to be entrained. The outer face is formed from a needled felt from highly temperature-resistant man-made fibers. On account of the structuring of the outer face of the mangle belt, a rough entrainment face or adhesion face, respectively, for the laundry items, that ensures slippage-free entrainment of the laundry items by the mangle belt while conveying the laundry items along the flattening face of the mangle body, is created.

21 Claims, 7 Drawing Sheets

(56) References Cited

FOREIGN PATENT DOCUMENTS

| | | | |
|---|---|---|---|
| DE | 202012004647 | U1 | 6/2012 |
| EP | 0135077 | A1 | 3/1985 |
| GB | 362380 | A | 11/1931 |

* cited by examiner

DEVICE FOR MANGLING LAUNDRY ITEMS

STATEMENT OF RELATED APPLICATIONS

This patent application claims priority on German Patent Application No. 102013016524.5 having a filing date of 7 Oct. 2013.

BACKGROUND OF THE INVENTION

1. Technical Field

The invention relates to a device for mangling laundry items, having at least one stationary mangle body and at least one revolvingly drivable mangle belt which is assigned to the at least one mangle body, wherein the laundry items are conveyable by the mangle belt through a mangling gap between the mangle body and the mangle belt.

2. Prior Art

Mangling laundry items of all types in particular takes place in commercial laundries, using various devices. What are referred to as trough-type mangles having at least one rotationally drivable trough roller and one heatable semi-circular mangle trough which is assigned to the former, or devices which are usually referred to as belt mangles and which display at least one stationary mangle body and at least one revolvingly drivable mangle belt which is assigned to the mangle body, are mainly used.

BRIEF SUMMARY OF THE INVENTION

The invention relates to belt mangles. In known devices of this type, the laundry items to be mangled are moved by the revolvingly driven mangle belt along the static mangle body. Here, the entrainment of the laundry items to be mangled is problematic. Above all, comparatively old mangle belts lead to slippage in relation to the laundry items, which compromises the surface integrity of the laundry items and leads to creases in the laundry items, which are amplified during mangling, on account of which the quality of mangling suffers.

The invention is based on the object of providing a device for mangling laundry items, which ensures high mangling quality and avoids compromising above all the sides of the laundry items which are oriented toward the mangle belts.

A device for achieving this objective is a device for mangling laundry items, having at least one stationary mangle body and at least one revolvingly drivable mangle belt which is assigned to the at least one mangle body, wherein the laundry items are conveyable by the mangle belt through a mangling gap between the mangle body and the mangle belt, characterized in that the at least one mangle belt displays an outer face which is structured so as to entrain the laundry items. It is accordingly provided that the at least one mangle belt displays an outer surface which is structured so as to entrain the laundry items. The outer face of the at least one mangle belt is preferably structured in such a manner that said outer surface entrains the laundry items in a frictionally engaged slippage-free manner or at least in a substantially slippage-free manner and, on account thereof, conveys said laundry items along the stationary mangle body. On account thereof, the quality problems encountered previously in the case of belt mangles can no longer arise.

It is furthermore preferably provided that the outer face of the respective mangle belt, which entrains the laundry items, is configured so as to be rough or roughened, respectively. The rough or roughened, respectively, outer face is constituted at least in part by its surface. It is achieved in this manner that the laundry items adhere to the respective mangle belt, so to speak, and on account thereof a slippage-free, or at least for the most part slippage-free, entrainment of the laundry items by way of the, or each, mangle belt is ensured.

It is preferably provided for the outer face of the mangle belt which comes into contact with the laundry items to be configured so as to be rough or roughened in such a manner that the outer face disposes of a coefficient of friction which is greater than the coefficient of friction of the laundry items. On account thereof, a particularly reliable frictionally engaged and/or slippage-free entrainment of the laundry items by the at least one mangle belt is obtained.

According to an advantageous refinement of the device, at least the outer face of the respective mangle belt which comes into contact with the laundry items is configured so as to be an entrainment face for the laundry items. The entrainment face holds the laundry items on the respective mangle belt when the latter is revolvingly driven. On account thereof, slippage between the laundry items and the entrainment face is avoided when the laundry items are conveyed in a sliding manner along the stationary mangle body by the driven mangle belt.

An advantageous refinement of the device provides that the mangle belt or each mangle belt displays at least one entrainment layer. It is preferably provided that the outer face or entrainment face, respectively, of the at least one mangle belt is formed and/or the entrainment face displays the outer face or entrainment face, respectively, on the side of the entrainment layer which points toward the laundry items or toward the mangle body, respectively. On account thereof, the entire entrainment face can be formed from one material which is structured and/or rough and, on account thereof, always an outer face or entrainment face, respectively, which ensures a reliable, in particular slippage-free, entrainment of the laundry items by the revolvingly driven mangle belt, even after a prolonged employment of the device, is available.

A further advantageous design embodiment of the invention provides for the at least one mangle belt to be provided with at least one longitudinal and/or transverse bracing. As a minimum, at least a longitudinal bracing of the mangle belt is provided such that, on account thereof, the mangle belt is not elongated or at least not significantly elongated in the longitudinal direction, specifically the revolving direction, despite the structured or rough, respectively, outer face or entrainment face, respectively. The respective mangle belt preferably also disposes of transverse bracings which make the mangle belt stable or at least more stable also in the direction which is transverse to the revolving direction, thus preventing contraction or expansion in the width. On account of the longitudinal and/or transverse bracings it is ensured that the respective mangle belt remains dimensionally stable also under load and, on account thereof, creasing of the laundry items entrained by the at least one mangle belt is avoided. On account of the longitudinal bracings it is moreover achieved that the at least one mangle belt can be moved along the mangle body while under tension and, on account thereof, optionally the laundry items are pressed against the flattening face of the mangle body which comes into contact with the laundry items by the respective mangle belt, thus contributing to the effective mangling or flattening, respectively, of the laundry items.

It is conceivable for the longitudinal and/or transverse bracings to be provided in the entrainment layer or a reverse side of the separate layer assigned to the entrainment layer which lies opposite the outer side or entrainment side, respectively. In the case of the last-mentioned alternative, the longitudinal and/or bracings are a component part of a separate traction support which is connected to the reverse side of the entrainment layer. Then, the respective mangle belt is configured with two layers, wherein both layers, that is to say the entrainment layer and the layer formed by the traction support are permanently and unreleasably connected to one another. Such a mangle belt having the required stability can be particularly advantageously manufactured.

The at least one mangle belt, in particular the entrainment layer, is formed from a felt-type material, preferably a coarsely structured felt-type material. Such a felt-type material disposes of a structured, above all coarsely structured, outer face which is particularly well suited as an entrainment layer. In particular, the felt or the felt-type material lends the outer face or entrainment layer, respectively, a coefficient of friction which is higher than the coefficient of friction of the laundry items to be flattened. The laundry items in a sense adhere to the felt or felt-type material, thus leading to the slippage-free entrainment and to the slippage-free conveying of the laundry items.

It is particularly advantageous for the felt or felt-type material of at least the entrainment layer at least for the most part to be formed from plastic material, preferably man-made fibers and/or plastic-material strands. On account thereof, a particularly effective slippage-free entrainment of the laundry items on the outer or entrainment face, respectively, and/or the entrainment layer is obtained.

It is in particular very advantageous for the felt or the coarsely structured felt, respectively, for forming the entrainment layer of the mangle belt or a large part of the mangle belt to be formed from a needled felt of highly heat-resistant material, in particular heat-resistant plastic material or man-made fibers, respectively, or man-made fiber pieces of preferably aramid. Mangle belts which are at least in part manufactured therefrom display permanently good entrainment properties of the laundry items, such that the latter are conveyable in a slippage-free manner and sliding manner by the or each mangle belt along the in particular smooth flattening face of the mangle body.

In an advantageous design embodiment of the device it is provided that the at least one mangle body is configured in a trough-like manner, and the outer or entrainment face, respectively, of the or each mangle belt is assigned to the flattening face of the respective mangle body, which is outwardly curved in a convex manner. On account of the at least one mangle body which is curved in a trough-like manner, the respective mangle belt, while under tension, can run along the outwardly curved flattening face of the respective mangle body. The tension of the mangle belt which is guided in a convex manner around the respective outwardly curved mangle body makes sure that the former not only adapts to the flattening face but is also pressed against the flattening face. On account thereof, for effective flattening or mangling, respectively, of the laundry items, the mangle belt presses the laundry items which are entrained by said mangle belt against the flattening face. In other words, the respective mangle belt is configured for pressing the laundry items against the flattening face of the respective mangle body.

The device may be formed from two trough-like mangle bodies which succeed one another in the mangling direction. In this case, each mangle body is advantageously configured so as to be approximately semi-circular. In this case, the two mangle bodies can be formed from a cylindrical body which is centrically cut open, wherein optionally the cutting faces are provided with a peripheral cover in order to close up a potential cavity in the respective mangle body. In exactly the same manner, a device having only a single semi-circular mangle body may also be formed. In this case, the mangle bodies for two devices having one large semi-circular mangle body are formed from one cylindrical base body of corresponding diameter.

It is provided in the case of a device having two or also more than two curved mangle bodies to assign a common single mangle belt to all mangle bodies. This simplifies the device. Above all, no drives for separate mangle belts are required.

Another preferred design embodiment of the invention provides for the respective mangle body to be configured so as to be planar, and the outer face or entrainment face, respectively, of the respective mangle belt to be assigned to the flattening face of the respective mangle body. In this case, the laundry items are conveyed by the revolvingly driven mangle belt through the mangling gap, which is also linear in the mangling direction, between the planar flattening face of the respective mangle body and the likewise planar outer face or entrainment face, respectively, of the or each mangle belt. Such a device having at least one planar-faced mangle body is particularly compact, namely flat. Such a belt mangle demands little space and, in the assembled state, can be easily transported.

Preferably, the at least one mangle body, which is configured so as to be flat, is configured for pressing the laundry items against the at least one mangle belt. To this end, means by way of which the laundry items are pressable by the respective mangle body against the mangle belt assigned thereto or also a plurality of mangle belts assigned to the mangle body are provided. In this case, these means are assigned to the respective mangle body. The means may be springs, pneumatic cylinders or similar spring-based or elastically, respectively, resilient components, for example.

In the case of another potential design embodiment of the device, a stationary drum-like mangle body is provided. Said mangle body may be for the most part surrounded by the revolving mangle belt.

According to another refinement of the device or belt mangle, respectively, the at least one mangle body is at least in part configured so as to be double-walled. To this end, the mangle body preferably displays a cavity or also a plurality of cavities for a heat-carrier medium in the double-walled region. On account thereof, the respective mangle body can be effectively heated, on account of which the flattening face thereof which points to the laundry items to be mangled is temperature-controllable, in particular heatable, to the desired extent.

BRIEF DESCRIPTION OF THE DRAWINGS

Preferred exemplary embodiments of the invention are described in more detail in the following by means of the drawing. In the drawings.

DETAILED DESCRIPTION OF PREFERRED EMBODIMENTS

Figure 1:
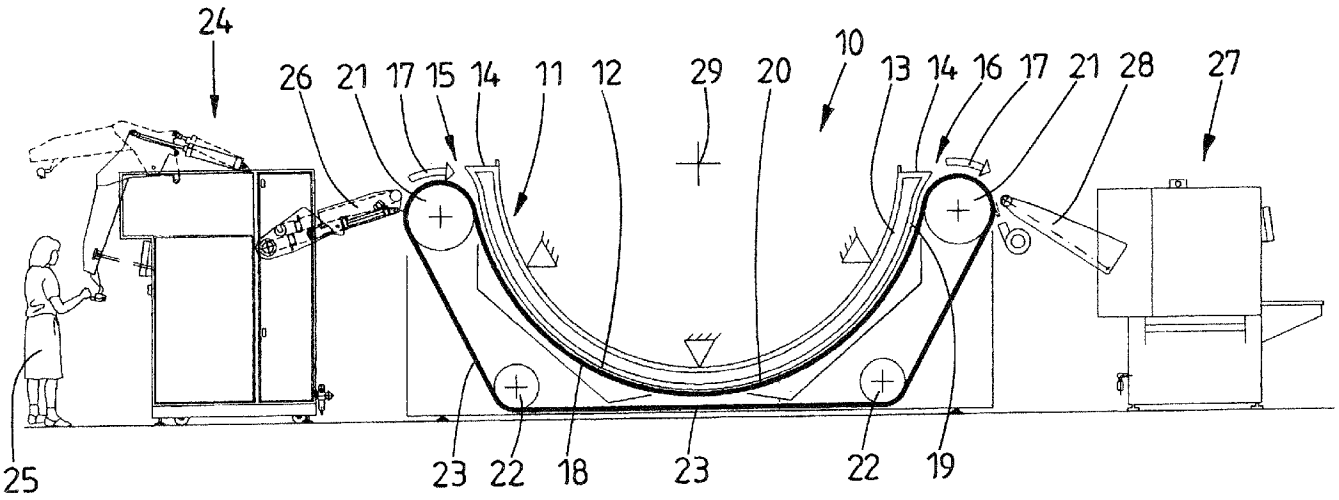
FIG. 1 shows a schematic side view of a device for mangling laundry items, which is configured as a belt mangle.

FIG. 1 shows a cross section through a device for flattening laundry items, which is configured as a belt mangle 10. In FIG. 1, and also in the remaining figures, the laundry items are not shown. The laundry items may be any type of laundry items, specifically both flatwork and also garments.

The shown belt mangle 10 disposes of a single, semi-circular, arcuate stationary mangle body 11. A convex outer face of the unmoved mangle body 11 forms a semi-circular flattening face 12 along which the laundry items to be mangled or to be ironed, respectively, are moved along in a sliding manner. To this end, the flattening face 12 is configured so as to be smooth, in that the steel, in particular stainless steel, from which the mangle body 11 is usually formed, is polished. Modifications in which the mangle body 11 is not outwardly curved in a semi-circular manner but displays a tub-like or trench-like cross section, having an outwardly curved convex flattening face, which departs from the semi-circular shape, are also conceivable. For example, the radius of the curvature of the mangle body 11 may be larger than a height. In the exemplary embodiment of FIG. 1, the mangle body 11 which is curved in a semi-circular manner displays a height which approximately corresponds to the radius of the curvature. In this case, the radius center point 29 lies approximately in the plane of the horizontal peripheries of the mangle body 11, which lie opposite.

The locationally fixed mangle body 11 in the shown exemplary embodiment is configured so as to be completely double-walled. On account thereof, a single continuous cavity 13 is created between the inner wall and the outer wall of the mangle body 11, which displays or forms, respectively, the flattening face 12. The cavity 13 serves for accommodating a heat-carrier medium, for example steam or heated thermal oil. For uniformly heating the flattening face 12 of the mangle body 11, the steam or the thermal oil, respectively, are channeled through the cavity 13, preferably in a continuous manner. Alternatively, it is also conceivable for a plurality of discrete cavities 13 to be formed in the interior of the double-walled mangle body 11. It is also conceivable for the mangle body 11 to be formed from two plates which are interconnected in a region-wise manner. For example, the mangle body 11 may be formed from what is referred to as a cushion plate having uniformly distributed across its face a grid of spot welds for connecting the two plates which are spaced apart between the welding spots. Thereby, the inner plate is curved between the welding spots in order to form flow ducts, while the outer plate, which forms the flattening face 12 and is usually thicker, is configured so as to be smooth. The mangle body 11 may also be electrically heatable. In this case, the mangle body 11 does not mandatorily have to be double-walled in order to form the cavity 17; it may also be single-walled in this case.

Opposite upper peripheries of the mangle body 11 are located on the entry region 15 and on the exit region 16 of the belt mangle 10. The peripheries are assigned peripheral covers 14 for the closure of the cavity 13 on the peripheral side. In the shown exemplary embodiment (FIG. 1), the entry region 15 is located on the left periphery of the mangle body 11, and the exit region 16 is located on the opposite right periphery of the mangle body 11. From the entry region 15 to the exit region 16, the laundry items (not shown) are moved in the mangling direction 17 along the flattening face 12 of the stationary mangle body 11 in a sliding manner.

A single revolvingly drivable mangle belt 18 is assigned in the shown exemplary embodiment to the outer or lower side, respectively, namely the flattening face 12, of the mangle body 11, which is curved in a convex manner. The endless mangle belt 18, with its upper leader, runs between the entry region 15 and the exit region 16 along the flattening face 12 of the mangle body 11, which is outwardly curved in a convex manner, when no laundry item is located in the mangling gap 19 between the flattening face 12 of the mangle body 11 and an upper outer face 20 of the upper leader of the mangle belt 18, which is oriented toward the flattening face 12. If a laundry item is located in the mangling gap 19, said laundry item lies between the flattening face 12 of the mangle body 11 and the outer face 20 of the mangle belt 18. On account of the upper leader of the tensioned mangle belt 18, which is guided in an approximate semi-circle around the flattening face 12 which is outwardly curved in a convex manner, the outer face 20 of the mangle belt 18, according to the principle of a band, adapts to the outwardly curved flattening face 12 of the mangle body 11 and thereby presses the laundry items against the flattening face 12.

The endless mangle belt 18 which is continuous across the entire width of the mangle body 11, but at least of the flattening face 12 of said mangle body 11, in the shown exemplary embodiment is guided over four deflection rollers, specifically over two upper deflection rollers 21 and two lower deflection rollers 22. The upper deflection rollers 21 lie at an identical height, wherein their horizontal rotation axes lie on a common horizontal plane. The height of the upper deflection rollers 21 is chosen in such a manner that they, together with the transverse peripheries of the mangle body 11, form the entry region 15 or the exit region 16, respectively. The upper leader of the mangle belt 18 which displays the outer face of the mangle belt 18 and which is imparted a semi-circular profile which is predefined by the curvature of the mangle body 11 by the stationary and substantially rigid mangle body 11 extends between the upper deflection rollers 21, wherein the semi-circular profile of the upper leader of the mangle belt 18 is imparted a convex, semi-circular profile, which is inwardly or downwardly, respectively, curved, by the mangle body 11 which is outwardly curved in a concave, trough-like manner.

Both the upper deflection rollers 21 and also the two lower deflection rollers 22 serve for guiding the lower leader 23 of the revolving mangle belt 18. The lower deflection rollers 22 likewise dispose of horizontal rotation axes which run in a horizontal plane, parallel below the plane of the rotation axes of the upper deflection rollers 21. The plane through the rotation axes of the lower deflection rollers 22 is spaced apart from the plane of the upper deflection rollers 21 to such an extent that a horizontal portion of the lower leader 23, which runs between the deflection rollers 22, runs past at a slight distance below the lowest point of the upper leader of the mangle belt 18, which is curved in a semi-circular manner.

For driving the mangle belt 18 in a revolving manner in the mangling direction 17, at least one of the deflection rollers 21 or 22 is rotationally drivable, preferably the upper deflection roller 21 (on the right in FIG. 1) which is assigned to the exit region 16 or forms the latter, respectively.

FIG. 1, in a schematic manner, shows an infeed machine 24 into which a laundry item to be mangled can be fed in in a gradual manner by at least one operator 25. By way of the infeed machine 24, the respective laundry item is deposited in a spread-out manner onto a supply conveyor 26 which, in a single-track operation mode, in each case supplies a single, spread-out laundry item, oriented longitudinally or transversely, to the entry region 15 of the belt mangle 10. In the case of a multiple-track operation mode of the infeed machine 24, a plurality of (comparatively small) laundry items which lie beside one another may be simultaneously conveyed by the supply conveyor 26 to the entry region 15 of the belt mangle 15, specifically optionally also in a transversely oriented manner.

In the shown exemplary embodiment, the exit region 16 of the belt mangle 10 is followed by a folding machine 27 which is disposed downstream of the former. From the exit region 16 of the belt mangle 10, the in each case mangled, flat laundry item make its way via an entry conveyor 28 into the folding region of the folding machine 27. In the folding machine 27, the mangled laundry items are automatically folded, specifically folded at least once longitudinally and/or transversely, depending on size. The folded laundry items are then optionally stacked by a separate folding unit which is assigned to the folding machine 27 or follows downstream thereof.

In the case of the belt mangle 10 of FIG. 1, the radius of the mangle body 11 may be up to 2.5 m, preferably up to 2 m. In this case, the belt mangle 10 is up to 2.5 m or 2 m, respectively, high and, on account thereof, may be transported even in the assembled state. The operating width of the belt mangle 10 may be substantially larger, specifically up to 6 m, preferably up to 5 m. Due to the maximum height of up to 2.5 m, said belt mangle 10 may be transported even when assembled. As a result of the mentioned operating width, also comparatively large laundry items may pass through the belt mangle 10 in a transverse manner, specifically optionally also in multiple tracks.

Figure 2:
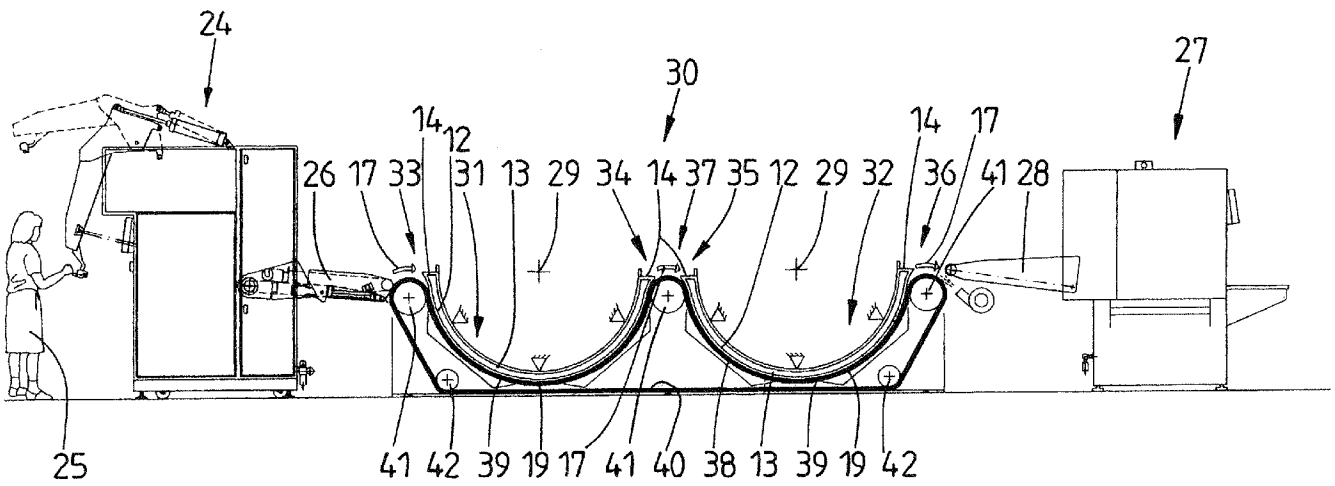
FIG. 2 shows a schematic side view of a second exemplary embodiment of a belt mangle.

FIG. 2 shows a belt mangle 30 according to the second exemplary embodiment of the invention. This belt mangle 30 in principle corresponds to the belt mangle of FIG. 1 and disposes of only two trough-like mangle bodies 31 and 32 which succeed one another in the mangling direction 17 and which are preferably of the same size. In the shown exemplary embodiment, the mangle bodies 31 and 32 which are likewise curved in a semi-circular manner are curved with a smaller radius which is preferably up to 1.5 m, preferably up to 1 m. In order to increase performance, the mangle bodies 31 and 32, however, may be configured so as to be of the same size as the mangle body 11.

As a result of the two successive mangle bodies 31 and 32, one entry region 33 of the first mangle body 31, when viewed in the mangling direction 17, one exit region 34 of the first mangle body 31, one entry region 35 of the second mangle body 32 which follows downstream, and one exit region 36 out of the belt mangle 30 are provided. Between the exit region 34 of the first mangle body 31 and the entry region 35 of the second mangle body 32, a transfer region 37 from the first mangle body 31 to the following second mangle body 37, when viewed in the mangling direction 17, is located.

The two successive mangle bodies 31 and 32 are assigned a single endless mangle belt 38 which is continuous across the entire width of each mangle body 31, 32. An outer face 39 which points toward the mangle bodies 31 and 32 and which comes into contact with the laundry items, runs past on the outside of both mangle bodies 31 and 32 which are outwardly curved in a convex trough-like manner and across the transfer region 37 between the two mangle bodies 31 and 32 which succeed one another with a slight spacing.

A lower leader 40 of the single revolving and continuous mangle belt 38 extends below the upper leader having the outer face 39, under the two mangle bodies 31 and 32. In the shown exemplary embodiment having two successive mangle bodies 31 and 32, the only mangle belt 38 is guided around three upper deflection drums 41 and two lower deflection drums 42. The first and the last upper deflection drums 41 are located in the entry region 33 of the first mangle body 31 and the exit region 36 of the second mangle body 32. In order to form the transfer region 37, the third upper deflection drum 41 is located between the exit region 34 of the first mangle body 31 and the entry region 35 of the second mangle body 32. All three upper deflection drums 41, with their rotation axes, lie in an upper horizontal plane through which, for instance, also the radius center points 29 of the two mangle bodies 31 and 32 which are configured so as to be of the same size run. In the shown exemplary embodiment, the horizontal plane of the radius center points is positioned somewhat above the horizontal plane of the rotation axes of the deflection drums 41. As is the case with the exemplary embodiment of FIG. 1, the two deflection drums 42 lie somewhat below the deepest points of the two mangle bodies 31 and 32, such that a portion of the lower leader 40 of the mangle belt 38 which runs in a horizontal plane between the deflection drums 42, runs under each mangle body 31 and 32 at a slight distance below the lowest point of the upper leader, having the outer face 39.

At least one deflection drum 41 or 42, respectively, is rotationally drivable. Here, this may be the last upper deflection drum 41. On account of the comparatively long mangle belt 38 it is, however, conceivable to drive a further deflection drum 41, for example the deflection drum in the transfer region 37 or in the entry region 33 of the belt mangle 30, in order to reduce elongation of said mangle belt 38 in the mangling direction 17.

In the remaining aspects, the belt mangle 30 corresponds to the belt mangle 10 of the first exemplary embodiment, such that identical reference signs are used for identical parts. The operating width of the belt mangle 30 may also correspond to that of the belt mangle 10. The height of the belt mangle 30 is only about half the height of the belt mangle 10, since on account of the two successive mangle bodies 31, 32 of the belt mangle 30, which are of the same size, the radius of the same semi-circular curvature of the mangle bodies 31, 32 is only half the size of the radius of the curvature of the mangle body 11.

Figure 3:
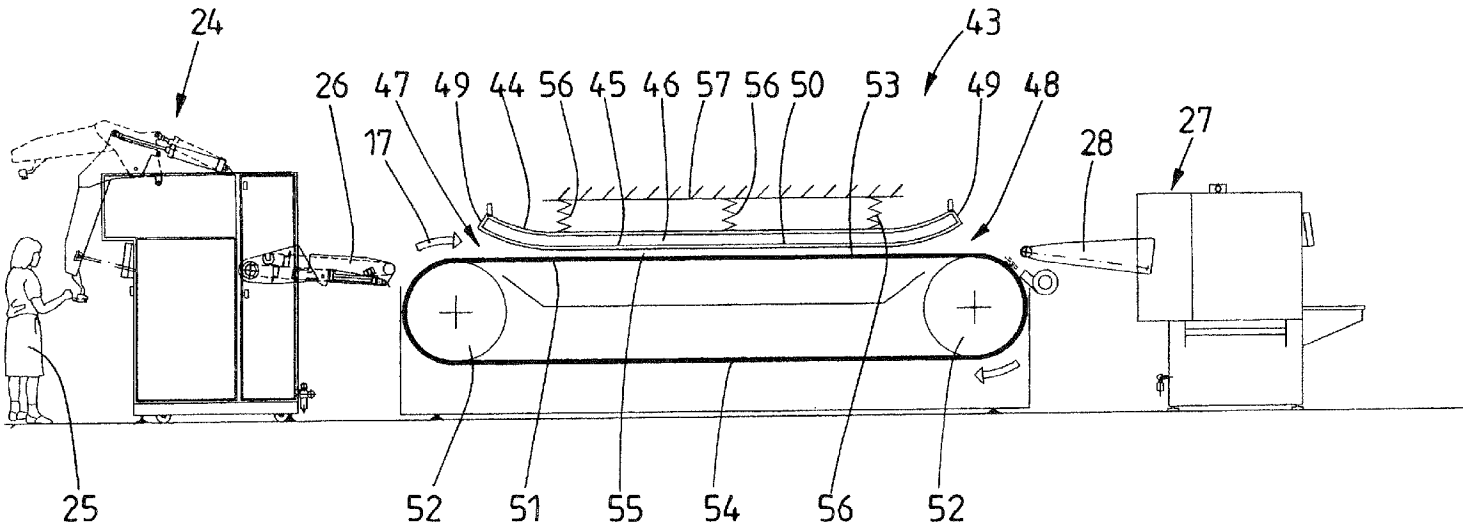
FIG. 3 shows a schematic side view of a third exemplary embodiment of a belt mangle.

FIG. 3 shows a further exemplary embodiment of a belt mangle 43 which displays a substantially linear mangle body 44 having a planar flattening face 45. As in the case of the mangle bodies 11, 31, and 32 in the previously described exemplary embodiments, the mangle body 44 is configured so as to be hollow in that, for heating, it displays a cavity 46 for a heat-carrier medium.

When viewed in the mangling direction 17, an entry region 47 is located ahead of the mangle body 44, and an exit region 48 at the end of the mangle body 44. On the transverse peripheries 49 which lie opposite, the mangle body 44 is somewhat bent upward, such that the entry region 47 and also the exit region 48 runs in a funnel-like manner to the planar-faced center portion 50 which lies therebetween. This linear center portion 50 which is planar-faced in the mangling direction 17, on its lower side, displays the flattening face 45 which is likewise planar and runs in a linear manner.

A single revolving mangle belt 51 is provided below the mangle body 44 in the shown belt mangle 43. The mangle belt 51 extends across the entire width of the belt mangle 43, or at least across the entire width of the flattening face 45 of the mangle body 44. The width of the mangle body 51 and of the mangle body 44 may be of the same size as in the case of the previously described belt mangles 10 and 30. The endless mangle band 51 is guided around two deflection drums 52, wherein one deflection drum 52 is assigned to the entry region 47 and the other deflection drum 52 to the exit region 48. Both deflection drums 52 dispose of horizontal rotation axes which lie in a common plane which runs parallel to the plane of the flattening face 45. At least one of the deflection drums 52 is rotationally drivable. A planar upper leader of the mangle belt 51, which runs in a linear manner, with its outer face 53 which points toward the laundry items or toward the flattening face 45, respectively, is disposed closely below the mangle body 44. A coasting lower leader 54 of the mangle belt 51 runs in a linear manner below the upper leader, specifically in a lower horizontal plane which is parallel thereto.

In the case of the belt mangle 43 shown here, having a linear flattening face 45 and a linear outer face 53 of the upper leader of the mangle belt 51 and the likewise linear mangling gap 55 which is formed therebetween and lies in one plane, the mangle body 44 is assigned means for pressing the same against the outer face 53 of the upper leader of the mangle belt 51. These means are, for example, a plurality of compression springs which are distributed across the length and width of the mangle body 44, or other units which generate elastic pretensioning between the mangle body 44 and the mangle belt 51, such as, for example, pneumatic cylinders. All compression springs 56, with their upper ends, are connected to a fixed support 57 which is only illustrated in part in FIG. 3. The support 57 may be part of the frame of the belt mangle 43 or display a fixed, preferably rigid, connection thereto. On account of the compression springs 56, the mangle body 44 which is substantially immovable in a longitudinal or transverse manner to the mangling direction 17 is pressed with elastic pretensioning in the perpendicular direction against the outer face 53 of the upper leader of the mangle belt 51 or the laundry items which are located between the outer face 53 and the flattening face 45, respectively. On account of this pressing force, flattening or mangling, respectively, of the laundry items is brought about when the latter run through the mangling gap 55. The pressing force of the mangle body 44 against the mangle belt 51 is so great that the laundry items in the mangling gap 55 are sufficiently clamped by the flattening face 45 of the mangle body 44 and the outer face 53 of the upper leader of the mangle belt 51. It may optionally be provided for the elastic pretensioning by which the mangle body 44 is pressed against the mangle belt 51 to be modified, for example by way of a re-adjustment of the support 47, corresponding to requirements, in the direction of pretensioning, that is to say perpendicular to the flattening face 45 and to the outer face 53.

In the case of the belt mangle 43 shown here, the upper leader of the mangle belt 51, which displays the outer face 53, is not supported between the deflection drums 52. By way of a corresponding pretensioning of the mangle belt 51 by way of adjusting the spacing of the deflection drum 52, the upper leader of the mangle belt 51 is stabilized so much that it does not yield or only yields to a slight degree when the mangle body 44 is pressed against the outer face 53 of the upper leader, such that a sufficient pressing force is exerted on the laundry items to be mangled, both by the flattening face 45 and also the outer face 53 of the mangle belt 51. It is also conceivable, however, for a planar, linear fixed support face to be optionally provided below the upper leader of the mangle belt 51, between the deflection drums 52, on which support face the reverse side of the same which lies opposite the outer face 53 of the upper leader which comes into contact with the laundry items is supported at least in the region of the planar-faced center portion 50 of the mangle body 44. This may be particularly expedient for increasing the pressing force of the mangle body 44 against the outer face 53 of the mangle belt 51.

In the shown exemplary embodiment, again an infeed machine 24 having a supply conveyor 26 and an operator 25 is provided ahead of the entry region 47 of the belt mangle 43. Moreover, also in the shown exemplary embodiment, a folding machine 27 having an entry conveyor 28 which takes over the in each case mangled laundry item from the exit region 48 of the belt mangle 43 is disposed downstream of the exit region 48 of the belt mangle 43.

On account of the uncurved, planar-faced mangle body 44 having a planar flattening face 45 which lies in a horizontal plane, the belt mangle 43 of FIG. 3 is distinguished by a very small constructive height. The length of the belt mangle 43, when viewed in the mangling direction 17, may vary corresponding to the performance potential and the requirements, such that the length of the flattening face 45 may be variable and almost arbitrary. The width of the belt mangle 43 may also be arbitrary. For example, the belt mangle 43 may have such a large width that large laundry items may be conveyed therethrough in multiple-tracks, even transversely oriented, and thereby may be flattened or mangled, respectively. It is also conceivable for the belt mangle 43 to display a greater width than length. However, the length-to-width ratio will typically be approximately equal, or the length will be larger than the width.

Figure 4:
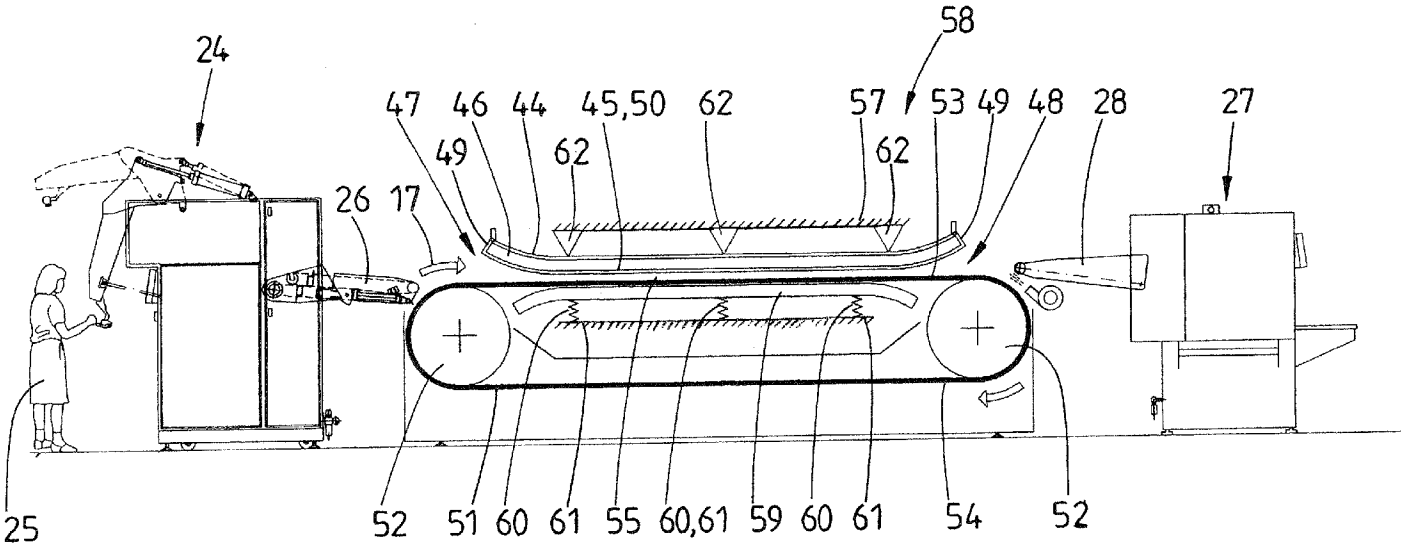
FIG. 4 shows a schematic side view of a fourth exemplary embodiment of a belt mangle.

A belt mangle 58 as per a fourth exemplary embodiment of the invention is schematically illustrated in FIG. 4. In principle, this belt mangle 58 is constructed exactly like the belt mangle 43, so that identical reference signs are used for identical parts. In particular, the flattening face 45 and the outer face 53 of the upper leader of the mangle belt 51 are configured so as to be planar-faced, having a linear profile in the mangling direction 17 and also transversely thereto.

In contrast to the belt mangle 43, in the case of the belt mangle 58 the mangle body 44 is connected to the locationally fixed support 57 by way of fixed bearings 62. Therefore, in the case of the belt mangle 58 the mangle body 44 is mounted in a substantially locationally fixed manner on the rigid frame of the belt mangle 58. Consequently, the mangle body 44 is not pretensioned by spring loading in a perpendicular manner to the flattening face and to the outer face 53 of the upper leader of the mangle belt 51. Instead, in the case of the belt mangle 58, the reverse side of the mangle belt 51, which lies opposite the outer face 53 of the upper leader of the mangle belt 51, is supported by a support plate 59 which is pretensioned by spring loading. The support plate 59 thus carries the upper leader of the mangle belt 51. The support plate 59, like the planar-faced center portion 50 of the flattening face 45 of the mangle body 44, is configured transversely thereto, so as to be planar-faced, having a linear profile in the mangling direction 17. In relation to said planar-faced center portion 50, the support plate 59 lies in a preferably horizontal plane which runs at a parallel spacing to the flattening face 45.

The lower side of the support plate 59 is assigned means for pressing the support plate 59 in a manner which is pretensioned by spring loading against the reverse side of the upper leader of the mangle belt 51. The shown exemplary embodiment also relates to a plurality of compression springs 60 which are disposed in a grid below the support plate 59. The compression springs 60, with their lower ends, bear on a dedicated or also a common support 61. All supports 61, or also the common support, are fixedly disposed, for example, fixedly connected to the frame of the belt mangle 58, or formed by the frame of the latter. The spring-loaded pretensioning of the compression springs 60 may be optionally adjusted by way of modifying the height of the support 61, in order to conform to the desired pressing force of the outer face 53 of the upper leader of the mangle belt 51 against the flattening face 45 or the laundry items, respectively.

Exactly like the mangle body 44, the support plate 59 is configured so as to be substantially rigid. On account thereof, the parallel linear profile of both the flattening face 45 and also the outer face 53 for the passing through of laundry items through the mangling gap 55 is always preserved, on account of which uniform squeezing of said laundry item across the complete area of the respective laundry item between the flattening face 45 of the mangle body 44 and the outer face 53 of the upper leader of the mangle belt 51 is established.

For the remaining part, an infeed machine 24 and a folding machine 27 are also provided in the case of the shown belt mangle 48. From a supply conveyor 26 of the infeed machine 24, the laundry items in the entry region 47 are conveyed onto the outer face 53 of the upper leader of the mangle belt 51 and deposited there. In the exit region 48, mangled laundry items are taken over by the entry conveyor 28 of the folding machine 27 from the upper leader of the mangle belt 51.

Figure 5:
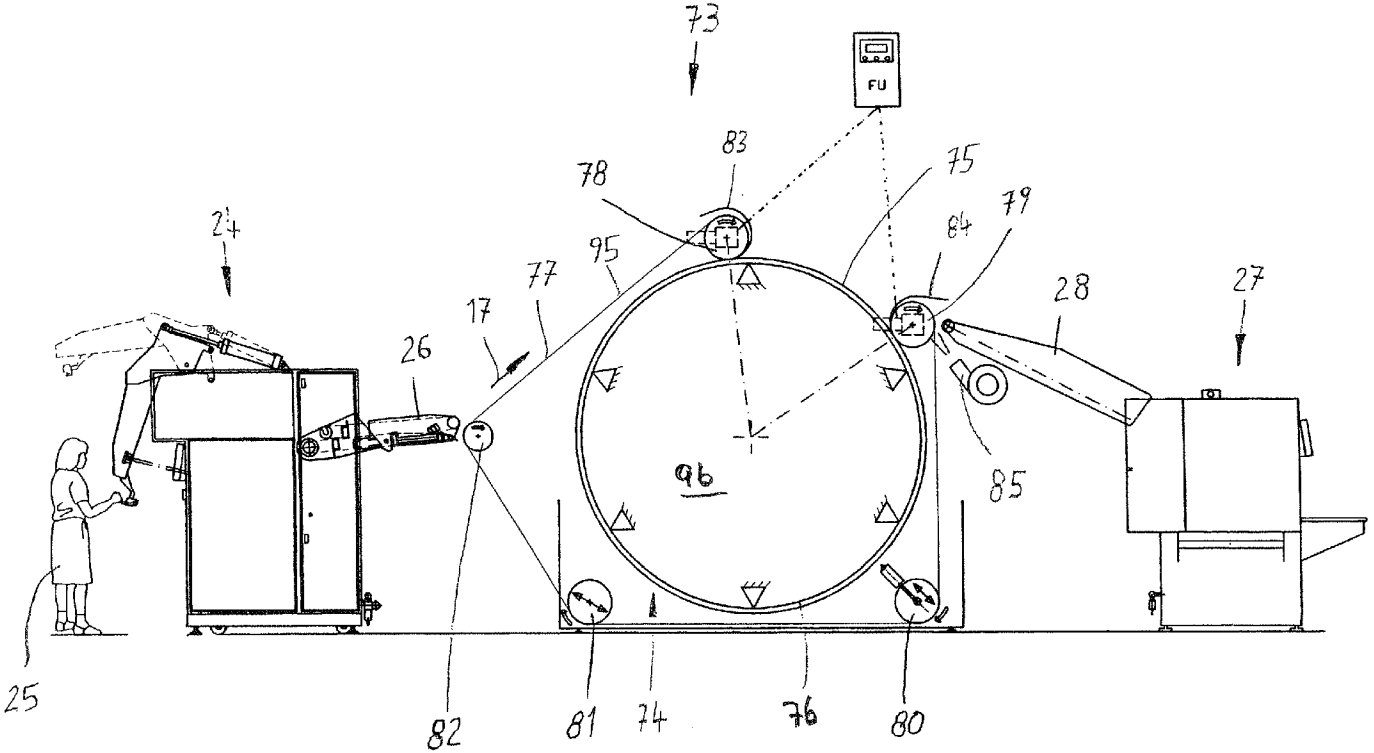
FIG. 5 shows a schematic view of a fifth exemplary embodiment of a belt mangle.

FIG. 5 shows a further exemplary embodiment of a belt mangle 73. The latter disposes of a single closed or drum-like, respectively, mangle body 74. The shown mangle body 74 is configured so as to be cylindrical. However, non-round mangle bodies are also conceivable, for example such having an oval or elliptical cross section. An outer side of the mangle body 74 forms a continuous, stationary flattening face 75. The flattening face 75 is preferably configured in the exact same manner as the flattening face 12 of the first exemplary embodiment.

The locationally fixed, stationary mangle body 74 is preferably configured so as to be entirely double-walled. On account thereof, a single continuous cavity 76 is created between the inner wall and the outer wall which forms the flattening face 75. The inner wall of the mangle body 74 encloses an interior 96 of the mangle body 74. However, it is also possible for a plurality of cavities to be formed in the interior of the mangle body 74. It is also conceivable for the double-walled mangle body 74 to be configured in the manner of what is referred to as a cushion plate having a cylindrical outer wall and a thinner, hydraulically formed inner wall. The inner wall is connected to the outer wall by way of a grid of welding spots, such that after the adjoining hydraulic forming, namely the widening of the thinner inner wall, a cushion structure having a network of flow ducts is created. The cavity 76 serves for receiving a heat-carrier medium, such as steam or heated thermal oil, for example.

It is also conceivable for the cylindrical mangle body 74 to be configured so as to be only single-walled. Heating of the flattening face 75 of the single-walled mangle body 74 in this case takes place from inside, for example by means of a burner which is disposed in the interior 96 of the stationary mangle body 74. Also in the case of a mangle body 74 which is configured so as to be double-walled, the heat-carrier medium can be heated in the cavity 76 by a heating apparatus which is accommodated in a space-saving manner in the interior 96 of the mangle body 74.

The cylindrical mangle body 74 of the belt mangle 73, on the outer side, is assigned a single, revolvingly drivable and endless mangle belt 77. The mangle belt 77 is guided around a major part of the outer circumference of the cylindrical mangle body 74, specifically preferably around 250° to 340°, preferably approximately 300°. On account thereof, only a major part of the cylindrical flattening face 75 is wrapped by the mangle belt 77.

In the shown exemplary embodiment, the endless mangle belt 77 which is continuous across the entire width of the mangle body 74 is deflected around five deflection drums 78 to 82. A deflection drum 78 which is disposed approximately above the uppermost point of the cylindrical mangle body 74 forms an entry region of the belt mangle 73. An adjacent deflection drum 79, ahead of the commencement of the entry conveyor 28 of the folding machine 27, forms an exit region of the belt mangle 73. The two deflection drums 78 and 79 are preferably drivable, specifically at a revolution speed which is predefined by a controller and is individually adjustable. The deflection drums 78 and 79 are preferably always driven at the same revolution speed. In order to adapt the mangle belt 77 to the flattening face 75 of the mangle body 74 in a tight manner, the deflection drum 79 in the exit region may also be driven at a slightly faster speed for the mangle belt 77 to be always tightly pressed against the flattening face 75. The deflection drums 80 and 81 are disposed on either side below the mangle body 74. Said deflections drums 80 and 81 are freely rotatable, on account of which one of the deflection drums 80 and/or 81 may be optionally re-adjustable for modifying the tension of the endless mangle belt 77. The fifth undriven deflection drum 82 is laterally disposed beside the mangle body 74. On account thereof, the mangle belt 77 is laterally deflected toward the delivery end of the supply conveyor 26 of the infeed machine 24, in order to transfer the spread-out laundry item to the mangle belt 77.

The mangle belt 77 is configured in the exact same manner as has been described in the context of the afore-described exemplary embodiments, in particular in the first exemplary embodiment of the belt mangle 10 and as will be discussed in more detail further below.

At least the circumferential regions of the driven deflection drum 78 and 79 which are wrapped by the mangle belt 77 are assigned a baffle 83 and 84 which in each case is continuous across the entire width of the deflection drum 78 and 79. The baffle 83 on the deflection drum 78 which forms the entry region deflects the laundry item, which has been deposited by the infeed machine 24 onto the mangle belt 77, on the deflection drum 78 in an infeed gap between the mangle belt 77 on the deflection drum 78 and the mangle body 74. The baffle 84 which is assigned to the deflection drum 79 on the exit region peels the mangled laundry item from the flattening face 75 of the mangle body 74, such that it remains adhering to the mangle belt 77 in the region of the deflection drum 79, until the transfer from the deflection drum 79 to the entry conveyor 28 of the folding machine 27 takes place. The release of the laundry item from the mangle belt 77 here may be supported by a ventilator having a wide slot nozzle 85 which is continuous across the entire width of the mangle belt 77.

Figure 6:
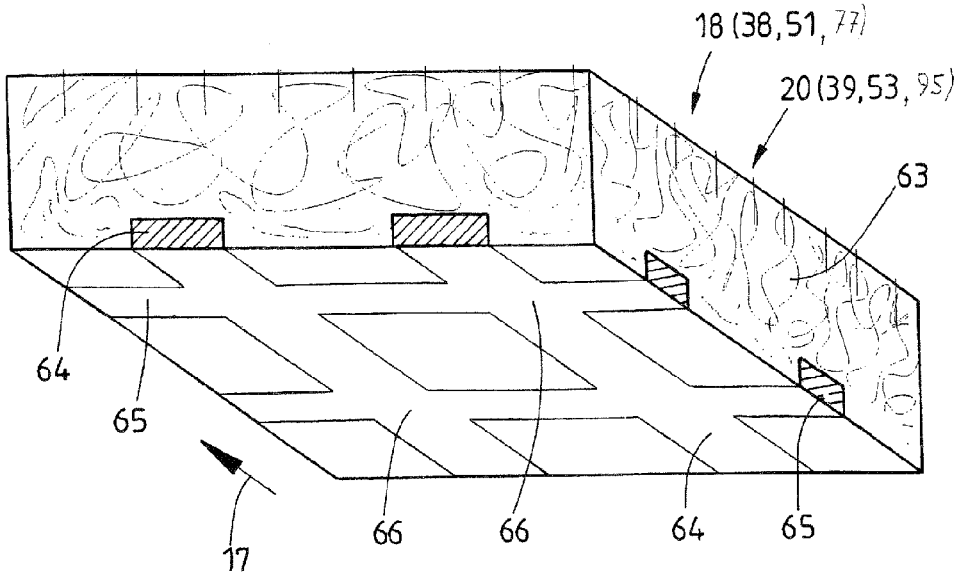
FIG. 6 shows a perspective partial section through a mangle belt of a belt mangle of FIGS. 1 to 5.

FIG. 6 shows in a perspective manner a detail of the mangle belt 18 of the exemplary embodiment of FIG. 1, which is illustrated in an enlarged manner. This here is a view from obliquely below toward the visible reverse side of the mangle belt, by way of which reverse side said mangle belt is guided around the deflection drums 21, 22. The opposite, upper side of the mangle belt 18 is the outer face 20 which comes into contact with the laundry items, specifically the lower side of said laundry items. This outer face 20 of the mangle belt 18 is configured so as to be structured. On account thereof, the mangle belt 18 can entrain the laundry items lying thereon and convey them along the stationary flattening face 12 of the mangle body 11. The outer face 20 of the mangle body 18 is thus an entrainment face of the latter which may also act and be described as an adhesion face and/or friction face.

Structuring of the outer face 20 of the mangle belt 18, which serves as an entrainment face, friction face and/or adhesion face, may take place in a variety of manners, for example by way of the construction of the mangle belt 18. It is preferably provided that at least the outer face 20 is configured so as to be rough or roughened. Roughening or roughening-up of the outer face 20 takes place in such a manner that the coefficient of friction of the outer face 20 is greater than that of the laundry item to be entrained. On account thereof, no slippage arises between the mangle belt 18 and the laundry item, when the laundry item is conveyed along the smooth flattening face 12 of the stationary mangle body 11.

The mangle belt 18 shown in FIG. 6 is configured so as to be single-layered. To this end, the mangle belt 18 displays only one entrainment layer 63 and/or adhesion layer or friction layer, respectively.

The entrainment layer 63 is formed from a felt, preferably a coarsely structured felt. The entrainment layer 63 is, in particular, formed from a needled felt. The felt or needled felt, respectively, is preferably composed of a heat-resistant or highly heat-resistant, respectively, material. For example, these may be man-made fibers, such as highly heat-resistant man-made fibers, preferably aramid, glass fibers, carbon fibers, or mixtures of such fibers. It is also conceivable for the entrainment layer 63 to be formed at least in part from natural fibers which display good heat resistance or are correspondingly treated. In the case of the entrainment layer 63 being formed from a needled felt, on account of this type of manufacturing the structured roughened outer face 20, or entrainment face, friction face and/or adhesion face, respectively, which displays good entrainment properties for the laundry items is established. However, it is also conceivable for the outer face 20 to be manufactured by way of other manufacturing methods, for example weaving or braiding, wherein the outer face 20 which serves as an entrainment face, on account of the type of weaving or other type of manufacturing, is imparted a higher coefficient of friction than the laundry items to be entrained and to be mangled.

On the lower side, the entrainment layer 63 is assigned a reinforcement which is preferably embedded in the entrainment layer 63. In the shown exemplary embodiment, these are longitudinal bracings 64 and transverse bracings 65 which intersect the former. The transverse bracings 65 may be optionally dispensed with. The bracings dispose of continuous strands which may be interconnected at intersection points 66, such that the reinforcement represents a mesh having preferably square intermediate spaces or mesh apertures, but may also be formed by mutually intersecting unconnected longitudinal strands and transverse strands. The longitudinal bracings 64 or longitudinal strands, respectively, run in the longitudinal direction of the mangle belt 18, that is to say in the mangling direction 17. The longitudinal bracings 64 run in an uninterrupted and encircling manner along the mangle belt 18. The transverse bracings 65 run transversely to the mangling direction 17, specifically preferably in an uninterrupted and continuous manner across the entire width of the mangle belt 18.

In the exemplary embodiment of FIG. 6, the longitudinal bracings 64 and the transverse bracings 65 are embedded in the entrainment layer 63 such that the longitudinal bracing 64 and the transverse bracing 65 are exposed on the lower reverse side but terminate in a flush manner with the reverse side, such that both the reverse sides of the longitudinal bracings 64 and the transverse bracings 65 and also the entrainment layer 63 bear on the sleeve faces of the deflection drum 21 and 22. An alternative exemplary embodiment of the mangle belt 18 of FIG. 5 in which the longitudinal bracings 64 and the transverse bracings 65 are entirely embedded inside the entrainment layer 63 is conceivable, that is to say that both the longitudinal bracings 64 and also the transverse bracings 65 are on all sides completely surrounded by the material of the entrainment layer 63, and the longitudinal bracings 64 and the transverse bracings 65 thus lie between the outer face 20 and the reverse side of the mangle belt 18, which lies opposite the outer face 20.

The longitudinal bracings 64 and the transverse bracings 65 are formed from a high-tensile material, for example continuous strands of carbon or glass fibers. Here, each longitudinal bracing 64 and each transverse bracing 65 is preferably composed of a bundle of continuous high-strength fibers, that is to say is configured so as to be a multifilament.

On account of the configuration of the mangle belt 18 as described above, two objects are achieved. On the one hand, on account of the structured roughened outer face 20, a frictionally engaged entrainment without slippage of the laundry items conveyed past the flattening face 12 by the mangle belt 18 is ensured. On the other hand, on account of the longitudinal bracings 64 and/or transverse bracings 65, the mangle belt 18 remains dimensionally stable, that is to say does not elongate in any significant manner in either the longitudinal direction, that is to say the mangling direction 17, nor in the transverse direction, despite the entrainment layer 23 being formed from a needled felt, for example. On account thereof it is possible for the mangle belt 18 in the tensioned state to press the laundry items against the flattening face 12. Above all, when tensioned, the mangle belt 18 does not contract in the transverse direction, which could lead to creasing of the laundry items to be mangled.

Figure 7:
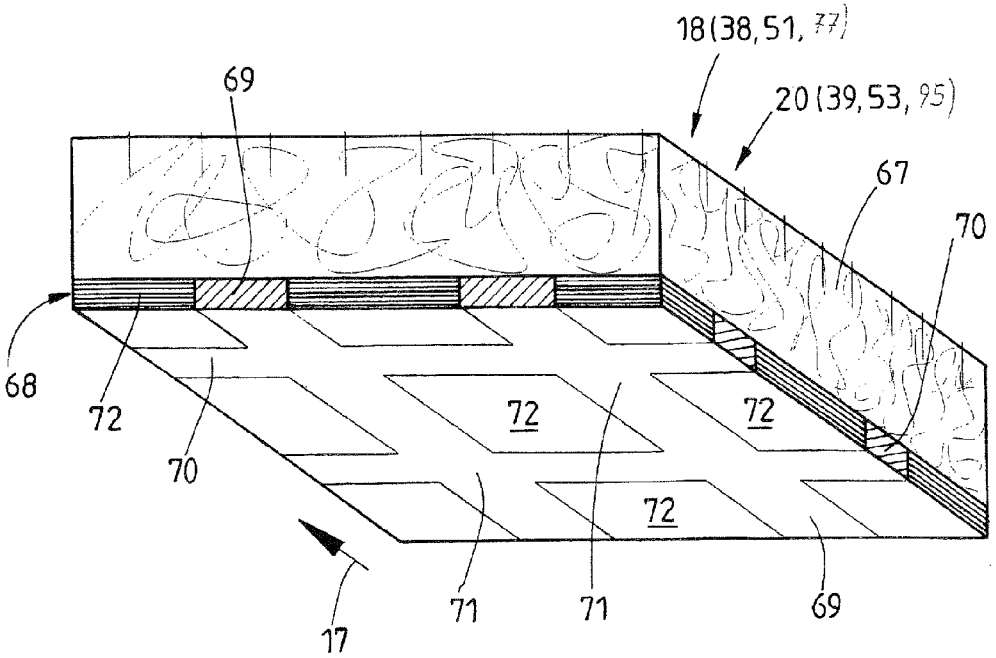
FIG. 7 shows a second exemplary embodiment of a mangle belt, in an illustration which is analogous to FIG. 6.

In FIG. 7, an alternative exemplary embodiment of the mangle belt 18, which is configured so as to be double-layered is shown, which is specifically composed of an upper entrainment layer 67, which displays the outer face 20 which comes into contact with the laundry items, and of a traction support 68 which is disposed below said entrainment layer 67. Here, the traction support 68 forms the second layer which may also be described as a traction-carrier layer. The entrainment layer 67, with its reverse side which is opposite the outer face 20, is permanently connected to the traction support 68, for example by adhesive bonding. However, other comparable connection techniques may also be used, for example sewing. On account of the connection of the traction support 68 to the entrainment layer 67, an integral mangle belt 18, of which the traction support 68 stabilizes the entrainment layer 67, results.

The entrainment layer 68 may be formed from the same material and manufactured in the exact same manner as the entrainment layer 63 of the exemplary embodiment of FIG. 5. To this extent, reference is made thereto. In particular, the entrainment layer 68 may also act as a friction layer or adhesion layer for the laundry items and be described as such.

The traction support 68 is mainly formed from longitudinal bracings 69 and transverse bracings 70, which may be connected at the intersection points 71. The longitudinal bracings 69 are configured like the longitudinal bracings 64 of the exemplary embodiment of FIG. 5, that is to say that they are also not elongatable or not significantly elongatable in the mangling direction 17 transversely thereto. On account thereof, the longitudinal bracings 69 and the transverse bracings 70 impart to the traction support 68 the required stability for fixing the entrainment layer 67 on the traction support 68 in relation to longitudinal and transverse elongations, and moreover, in particular the longitudinal bracings 69 serve for transmitting the driving forces from at least one deflection drum 21 onto the mangle belt 18. Since it is substantially tensile forces which are exerted on the mangle belt 18, it is conceivable for the transverse bracing 70 and also 65 to be dispensed with, or for the transverse bracings 70 or 65, respectively, to be provided with a lesser cross section than the longitudinal bracings 69 or 64, respectively. The spacings between the transverse bracings 70 or 65, respectively, may also be greater than between the longitudinal bracings 69 or 64, respectively.

In the case of the exemplary embodiment of FIG. 7, the traction support 68 which covers the entire area is created by filling the intermediate spaces between the longitudinal bracings 69 and the transverse bracings 70, which run in a mesh-like manner, with a filler material 72. Here, this is preferably a flexurally elastic material, for example an elastomer or a plastomer, such as plastic, polyurethane, or the like. The filler material 72 is connected to the flanks of the transverse bracings 70 and the longitudinal bracings 69, specifically in a thermal manner and/or by adhesive bonding. On account of the filler material 72 and the longitudinal bracings 69 and the transverse bracings 70, a continuous, low-elongation traction support 68 which covers the full area is created below the reverse side of the entrainment layer 67. Optionally, the filler material 72 may also be connected to the reverse side of the entrainment layer 67.

The mangle belts 38, 51, and 77 of the belt mangles 30, 43, 58, and 73 may be configured in a similar manner to the afore-described mangle belts 18.

Figure 8:
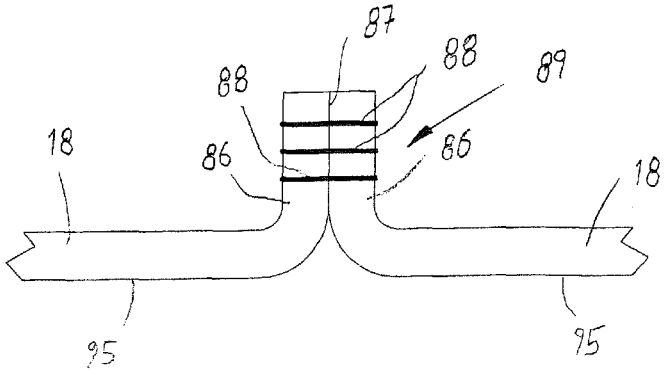
FIG. 8 shows a side view of a first potential design of a connection point of the mangle belt.
Figure 9:
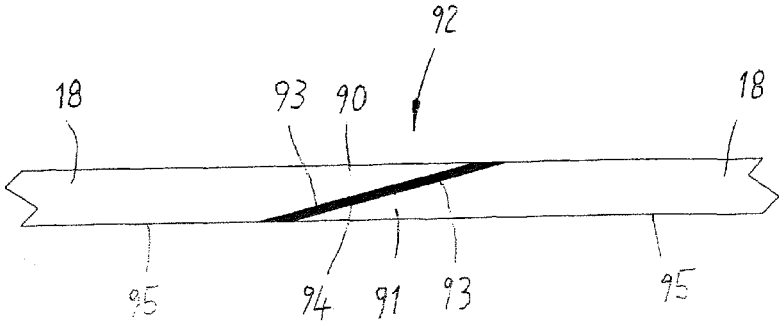
FIG. 9 shows a side view of a second potential design of a connection point of the mangle belt.

FIGS. 8 and 9 depict alternative possibilities for making the mangle belts endless. These possibilities will be described in more detail by means of the mangle belt 18.

In the case of the exemplary embodiment of FIG. 8, narrow end regions on both ends of the mangle belt 18, which has not yet been made endless, are bent over by approximately 90°, specifically in a direction which is transverse to the running direction of the mangle belt 18 which corresponds to the mangling direction 17. The narrow end regions 86, the lengths of which corresponds to approximately 3 to 10 times the thickness of the mangle belt 18, preferably to approximately 3 to 4 times that thickness, are connected in an overlapping region 87 where the end regions bear on one another with sides which are oriented toward one another. In the shown exemplary embodiment, this connection takes place by way of three parallel longitudinal seams 88 which run in a continuous manner across the entire width of the mangle belt 18. The longitudinal seams 88 are produced by machine, using conventional sewing practices, or by hand. Alternatively, instead of the longitudinal seams, the connection may also take place by adhesive bonding or by way of staples. It is also conceivable for the end regions 86 in the overlapping region 87 to be both adhesively bonded and also sewn or stapled.

The end regions 86 of the mangle belt 18 are bent over in the outward direction, that is to say toward that side of the mangle belt 18 which faces away from the flattening face 12. On account thereof, the overlapping connection 89 which is created when making the belt endless as per FIG. 8 does not interfere, in particular does not leave behind any imprints on the laundry to be mangled.

In the case of the exemplary embodiment of FIG. 9, the ends 90, 91 of the mangle belt 18, which are to be connected, are connected by way of an oblique joint 92. To this end, both ends 90 and 91 are uniformly beveled, specifically at an angle of approximately 10° to 15° in relation to the face of the mangle belt 18. On account of the beveling, connection faces 93, the width of which is a multiple, in particular 3 to 4 times, the thickness of the mangle belt 18, are created. The ends 90 and 91 of the mangle belt 18 are adhesively bonded to one another on these comparatively wide connection faces 93 by way of an obliquely oriented adhesive seam 94 in the region of the oblique joint 92. Alternatively or additionally, the ends 90 and 91 of the mangle belt 18 may also be connected in the region of the oblique joint 92 by way of sewing and/or needling. Needling is to be considered above all in the case of mangle belts 18 which are at least in part manufactured from a needled felt or another needled material.

The mangle belts 38, 51 and 77 may also be configured and made endless like the mangle belt 18 which has been described above.

LIST OF REFERENCE NUMBERS

10 Belt mangle
11 Mangle body
12 Flattening face
13 Cavity
14 Peripheral cover
15 Entry region
16 Exit region
17 Mangling direction
18 Mangle belt
19 Mangling gap
20 Outer face
21 Deflection drum
22 Deflection drum
23 Lower leader
24 Infeed machine
25 Operator
26 Supply conveyor
27 Folding machine
28 Entry conveyor
29 Radius center point
30 Belt mangle
31 Mangle body
32 Mangle body
33 Entry region
34 Exit region
35 Entry region
36 Exit region
37 Transfer region
38 Mangle belt
39 Outer face
40 Lower leader
41 Deflection drum
42 Deflection drum
43 Belt mangle
44 Mangle body
45 Flattening face
46 Cavity
47 Entry region
48 Exit region
49 Transverse periphery
50 Planar-faced center portion
51 Mangle belt
52 Deflection drum
53 Outer face
54 Lower leader
55 Mangling gap
56 Compression spring
57 Support
58 Belt mangle
59 Support plate
60 Compression spring
61 Support
62 Bearing
63 Entrainment layer
64 Longitudinal bracing
65 Transverse bracing
66 Intersection point
67 Entrainment layer

68 Traction support
69 Longitudinal bracing
70 Transverse bracing
71 Intersection point
72 Filler material
73 Belt mangle
74 Mangle body
75 Flattening face
76 Cavity
77 Mangle belt
78 Deflection drum
79 Deflection drum
80 Deflection drum
81 Deflection drum
82 Deflection drum
83 Baffle
84 Baffle
85 Wide slot nozzle
86 End region
87 Overlapping region
88 Longitudinal seam
89 Overlapping connection
90 End
91 End
92 Oblique joint
93 Connection face
94 Adhesive seam
95 Outer face
96 Interior

The invention claimed is:

1. A mangle for mangling laundry items, having at least one stationary mangle body (11; 31; 32; 44; 74) and at least one revolvingly drivable mangle belt (18; 38; 51; 77) which is assigned to the at least one mangle body (11; 31; 32; 44; 74), wherein the laundry items are conveyable by the mangle belt (18; 38; 51; 77) through a mangling gap (19) between the mangle body (11; 31; 32; 44; 74) and the mangle belt (18; 38; 51; 77), wherein the at least one mangle belt (18; 38; 51; 77) comprises an outer face (20; 39; 53; 95) which is structured so as to entrain the laundry items, wherein the at least one mangle belt (18; 38; 51; 77) comprises longitudinal bracings (64; 69) and/or transverse bracings (65; 70).

2. The mangle according to claim 1, wherein the outer face (20; 39; 53; 95) of the mangle belt (18; 38; 51; 77, which entrains the laundry items, is configured so as to be rough or roughened, respectively.

3. The mangle according to claim 1, wherein the outer face (20; 39; 53; 95) of the mangle belt (18; 38; 51; 77) is configured so as to be rough and roughened in such a manner that the outer face (20; 39; 53; 95) disposes of a coefficient of friction which is greater than a coefficient of friction of the laundry items.

4. The mangle according to claim 1, wherein the outer face (20; 39; 53; 95) of the mangle belt (18; 38; 51; 77) which comes into contact with the laundry items is configured so as to be an entrainment face, adhesion face and/or friction face.

5. The mangle according to claim 4, wherein the mangle body (44) is configured so as to be planar, and the outer face (53) or entrainment face, adhesion face and/or friction face, respectively, of the mangle belt (51) cooperates with the flattening face (45) of the planar mangle body (44).

6. The mangle according to claim 1, wherein the mangle belt (18; 38; 51; 77) comprises at least one entrainment layer (63; 67), wherein a side of the entrainment layer (63; 67) which points toward the laundry items or the mangle body (11; 31; 32; 44; 74), respectively, forms the outer face (20; 39; 53; 95).

7. The mangle according to claim 6, wherein the longitudinal bracings (64; 69) and/or transverse bracings (65; 70) are disposed in the entrainment layer (63; 67) or cooperate with a traction support (68) of the mangle belt (18; 38; 51; 77), wherein a reverse side of the entrainment layer (63; 67), which lies opposite the entrainment layer (63; 67), is fixedly connected to the traction support (68).

8. The mangle according to claim 6, wherein the at least one entrainment layer (63; 67) is at least in part formed from a coarsely structured felt-type material having a structured surface for forming the outer face (20; 39; 53; 95).

9. The mangle according to claim 8, wherein the felt-type material of at least the entrainment layer (63; 67) is at least for the most part formed from heat resistant plastic material.

10. The mangle according to claim 6, wherein the at least one entrainment layer (63; 67) is at least in part formed from a felt-type material having a structured surface for forming the outer face (20; 39; 53; 95).

11. The mangle according to claim 10, wherein the felt-type material of at least the entrainment layer (63; 67) is at least for the most part formed from plastic material wherein the plastic material is heat resistant.

12. The mangle according to claim 11, wherein the felt-type material is a needled felt.

13. The mangle according to claim 10, wherein the felt-type material of at least the entrainment layer (63; 67) is at least for the most part formed from man-made fibers.

14. The mangle according to claim 13, wherein the felt-type material of at least the entrainment layer (63; 67) is a needled felt.

15. The mangle according to claim 14, wherein the felt-type material of at least the entrainment layer (63; 67) is at least for the most part formed from heat resistant plastic fibers.

16. The mangle according to claim 1, wherein the mangle body (11; 31; 32) is curved in a trough-like manner, so as to form an outer face or lower-side flattening face (12), respectively, which is outwardly curved in a convex manner, and the outer face (20; 39) of the mangle belt (18; 38) which bears on the laundry items cooperates with the flattening face (12) of the mangle body (11; 31; 32), which is outwardly curved in a convex manner.

17. The mangle according to claim 1, wherein the respective mangle belt (18; 38; 51; 77) is configured for pressing the laundry items against the mangle body (11; 31; 32; 44; 74).

18. The mangle according to claim 1, wherein the mangle body (44) is configured for pressing the laundry items against the mangle belt (51), and/or means by way of which the laundry items are pressable by the mangle body (44) against the mangle belt (53) are provided.

19. The mangle according to claim 1, wherein the mangle body (74) is configured as a stationary drum, wherein the mangle body (74) for the most part is surrounded by the revolvingly driven mangle belt (77).

20. The mangle according to claim 1, wherein the at least one mangle body (11; 31; 32; 44; 74) is at least in part configured so as to be double-walled and comprises at least one cavity (13; 46) for a heat-carrier medium in the double-walled region.

21. The mangle according to claim 1, wherein the mangle body (74) is configured as a stationary cylindrical drum, wherein the mangle body (74) for the most part is surrounded by the revolvingly driven mangle belt (77).

* * * * *